US006773365B2

(12) United States Patent
Wilson

(10) Patent No.: US 6,773,365 B2
(45) Date of Patent: Aug. 10, 2004

(54) BASKETBALL REBOUNDING PRACTICE DEVICE

(76) Inventor: Rayburn L. Wilson, 16750 Parthenia St., #241, Northridge, CA (US) 91343

( * ) Notice: Subject to any disclaimer, the term of this patent is extended or adjusted under 35 U.S.C. 154(b) by 0 days.

(21) Appl. No.: 10/238,060

(22) Filed: Sep. 10, 2002

(65) Prior Publication Data

US 2004/0048695 A1 Mar. 11, 2004

(51) Int. Cl.[7] ..... A63B 69/00
(52) U.S. Cl. ..... 473/449; 473/423
(58) Field of Search ..... 473/449, 430, 473/147, 435, 436, 448, 422; D21/704

(56) References Cited

U.S. PATENT DOCUMENTS

| | | | | |
|---|---|---|---|---|
| 2,694,572 A | | 11/1954 | Crisp | |
| 3,023,001 A | * | 2/1962 | Gourdouze | 473/430 |
| 3,173,687 A | | 3/1965 | Hair | |
| 3,348,840 A | | 10/1967 | Dix | |
| 3,795,401 A | | 3/1974 | Voltz et al. | |
| 4,161,313 A | | 7/1979 | Dickey | |
| 4,621,811 A | * | 11/1986 | Campbell | 473/430 |
| 5,338,026 A | * | 8/1994 | Kregel | 473/147 |
| 5,503,389 A | | 4/1996 | Campbell | |
| 5,792,014 A | * | 8/1998 | Brown | 473/430 |
| D429,784 S | | 8/2000 | Brown | |

* cited by examiner

*Primary Examiner*—Stephen P. Garbe
*Assistant Examiner*—M. Chambers
(74) *Attorney, Agent, or Firm*—Park & Sutton LLP; John K. Park

(57) ABSTRACT

A basketball rebounding practice device is provided. The device includes a support member that can removably attached onto a rim of a basketball hoop, and one or more arm members attached to the support member. Each of the arm members comprise a beam having one end attached to the support member and the other end extending beyond the circumference of the rim by a predetermined length, and a string attached to the beam and hanging off the other end of the beam. The string is attached at its hanging end to a basketball. The arm member also comprises a cable winch attached to the beam for adjusting the handing distance of the string.

20 Claims, 7 Drawing Sheets

BASKETBALL REBOUNDING PRACTICE DEVICE

BACKGROUND

The present invention relates to the field of sports and athletics. More particularly, the invention relates to basketball. Basketball is usually defined as a court game between two teams of usually five players each, who score by tossing an inflated ball through a raised goal. While this definition succinctly conveys the main idea behind the game of basketball, what it leaves out is just as important as what it includes.

There are many aspects to the game of basketball, which in turn, requires that its players be multi-dimensional players. Basketball players cannot be content with simply throwing the ball into the hoop and being a good shooter. They must develop quickness, agility, concentration, and strength. In short, they must develop their skill at rebounding.

Rebounding is the act of regaining possession of the ball after it fails to go through the hoop. It often involves anticipating, jumping, grabbing, pulling down, or tipping. Practice in rebounding skills may be difficult, however, because an initial shot must be missed. Furthermore, time and energy is wasted when the ball goes in or when the ball goes astray and the player must chase it down.

These concerns translate into a need for an invention that assists basketball players with rebounding practice. Much of the prior art have either been too costly, too difficult to operate, or do not address all of these concerns.

Therefore, there is a need for a system that is designed to allow the user to simulate missed shots from different positions on the court, that allows for a rebound, and saves the player's time and energy by keeping the ball within a readily-accessible area.

SUMMARY

An object of the invention is to provide a basketball rebounding practice device that can be used by multiple players simultaneously.

Another object of the invention is to provide a basketball rebounding practice device that can adjust the heights of the basketballs that are attached to the device.

Still another object of the invention is to provide a basketball rebounding practice device that can hold basketballs at different distances from the basketball hoop.

Still another object of the invention is to provide a basketball rebounding practice device that is simple and easy to manufacture.

Still another object of the invention is to provide a basketball rebounding practice device that can be easily attached to and detached from a rim of a basketball hoop.

In order to achieve the above objects, the present invention provides a basketball rebounding practice device comprising a support member that can removably attached onto a rim of a basketball hoop, and one or more arm members attached to the support member. Each of the arm members comprises a beam having a first end attached to the support member and a second end extending beyond the circumference of the rim by a predetermined length, and a string attached to the beam and hanging off the second end of the beam. The string is capable of being attached at its hanging end to a basketball. The device may further include support bar attached to the support member. The length of the support bar is approximately same as the diameter of the rim of the basketball hoop.

Preferably, the number of arm members may be 3 or 5 depending on the practice situations.

Also, preferably, the predetermined length by which the second end of the beam extends beyond the rim is about 12 or 15 inches.

The arm member further comprises a cable winch attached to the beam for adjusting the hanging distance of the string. The cable winch has a first wall, a second wall, a winch pulley, a first wheel, and a second wheel. The winch pulley is rotationally attached between the first wall and the second wall. The first wheel is fixed to the winch pulley so that rotating the first wheel rotates the winch pulley. The second wheel is attached to winch pulley so that rotating the second wheel in one direction locks the winch pulley and rotating the second wheel in the other direction unlocks the winch pulley. The first wall and second wall are attached to the beam of the arm member.

The beam of the arm member includes a channel in which the string runs, and a stopper at the second end for preventing the string from getting out of the channel. The beam may further include an edge pulley at the second end, and the string goes over the edge pulley before it hangs off the beam.

The support member includes a base plate on which the first ends of the beams are attached. The support member also includes a ring. The ring has a semi-circular cross-section, and the beams are attached on the ring.

The support member further includes a plurality of fastening members that fasten the ring to the rim of the basketball hoop. The fastening member includes a plate having a curved portion and a flat portion, a bolt having a hook on one end, and a butterfly nut. The curved portion sits on the ring and the flat portion has a hole. The bolt passes through the hole in the plate. Fastening the butterfly nut makes the hook and the curved portion surround the ring and the rim of the basketball hoop and secures the ring to the rim.

A user can attach a basketball to the string, and throw the basketball toward the hoop, where the members would prevent the basketball from going through. The basketball would bounce off the rim, the backboard, or the support member. The user would then have the opportunity to try to rebound the ball.

The basketball rebounding practice device of the present invention is light and has simple structure. It can be manufactured at low cost. It can be readily attached to a rim of a basketball hoop. The various length of the arm(s) and adjustable length of the dangling string(s) allow the user to simulate shots from different distances from the rim, and at different heights from the ground which create varying degrees of bounce. This allows the user to practice long and short rebounds, as well as practice tipping the ball toward the hoop. If the user misses the rebound or the ball bounces wildly astray, the string keeps the ball within easy reach for another shoot-and-rebound attempt.

BRIEF DESCRIPTION OF THE DRAWINGS

These and other features, aspects and advantages of the present invention will become better understood with reference to the accompanying drawings, wherein.

DESCRIPTION

Figure 1:
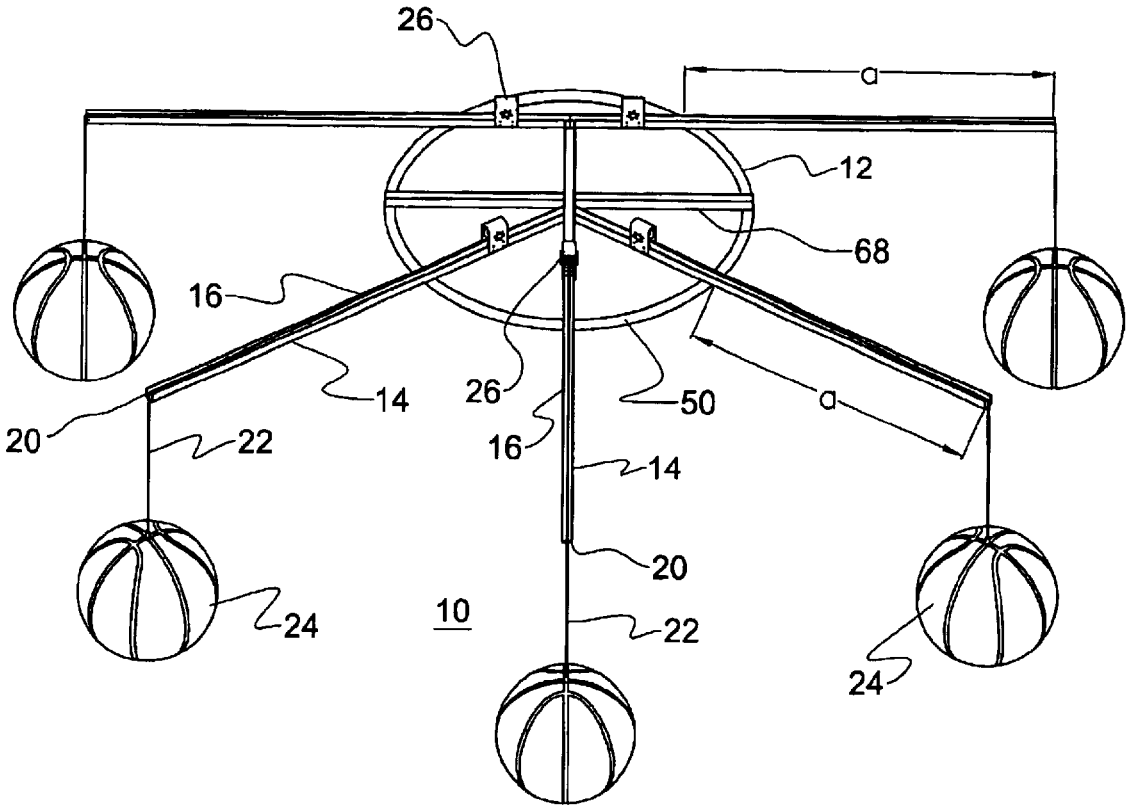
FIG. 1 is a perspective view showing a basketball rebounding practice device of the present invention.
Figure 2:
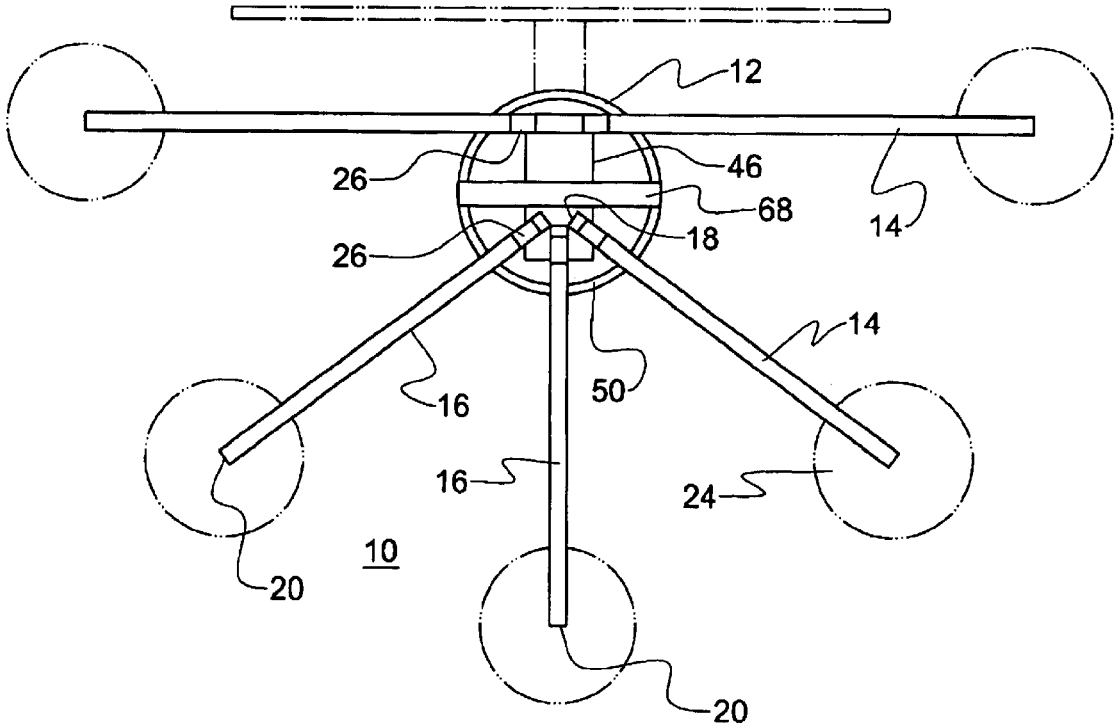
FIG. 2 is a plan view of the basketball rebounding practice device.
Figure 3:
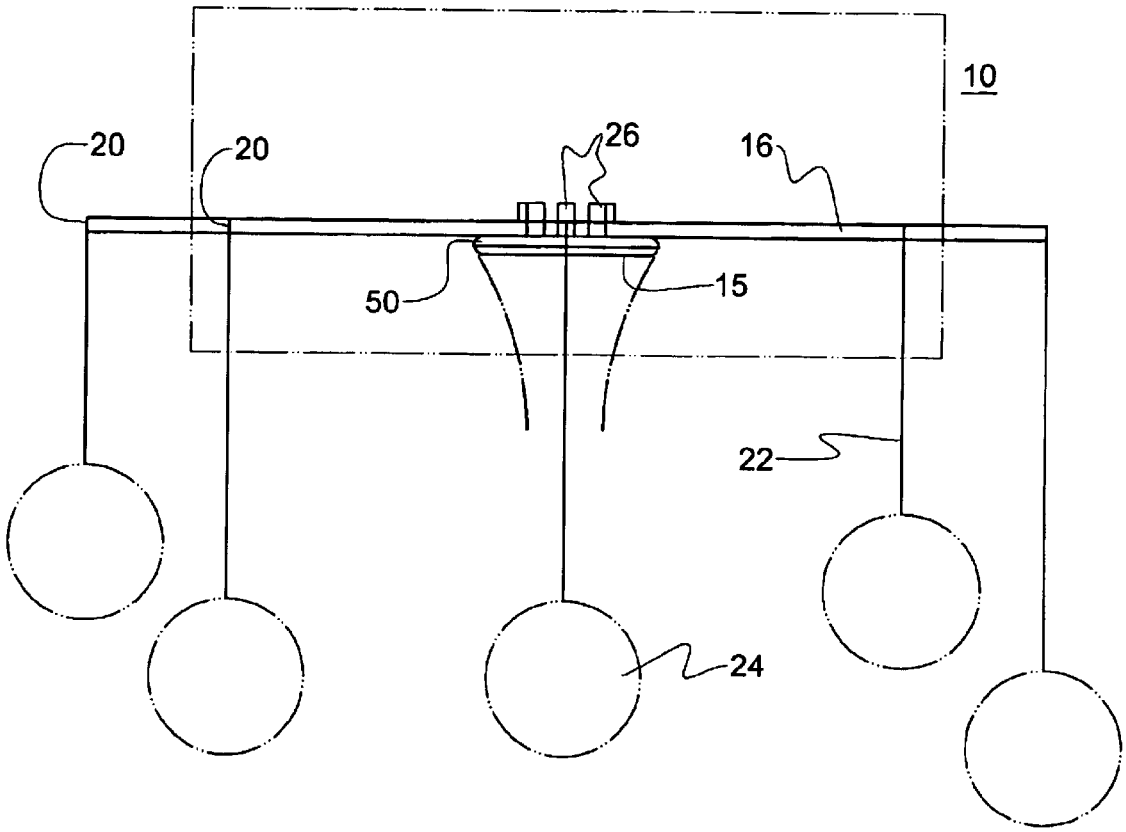
FIG. 3 is an elevational view of the basketball rebounding practice device.

FIGS. 1–3 show a basketball rebounding practice device 10 according to the present invention. The device 10 includes a support member 12 that can removably attached onto a rim 15 of a basketball hoop, and one or more arm members 14 attached to the support member 12. Each of the arm members 14 comprises a beam 16 having a first end 18 attached to the support member 12 and a second end 20 extending beyond the circumference of the rim 15 by a predetermined length a, and a string 22 attached to the beam 16 and hanging off the second end 20 of the beam 16. The string 22 is capable of being attached at its hanging end to a basketball 24, for example by velcro strips surrounding the basketball. The string 22 may comprise of rope, wire, elastic or other flexible materials.

The arm members 14 criss-cross over the rim 15. Along with supporting the basketballs 24, they also serve to prevent thrown basketballs from going through the rim 15. Five arm members are depicted in FIG. 1, although the invention allows for varying numbers of arms. Depending on the practice situations, the number of arms may be 3. Also, depending on the practice situations, the predetermined length a is preferably about 12 (twelve) inches or 15 (fifteen) inches.

Figure 4:
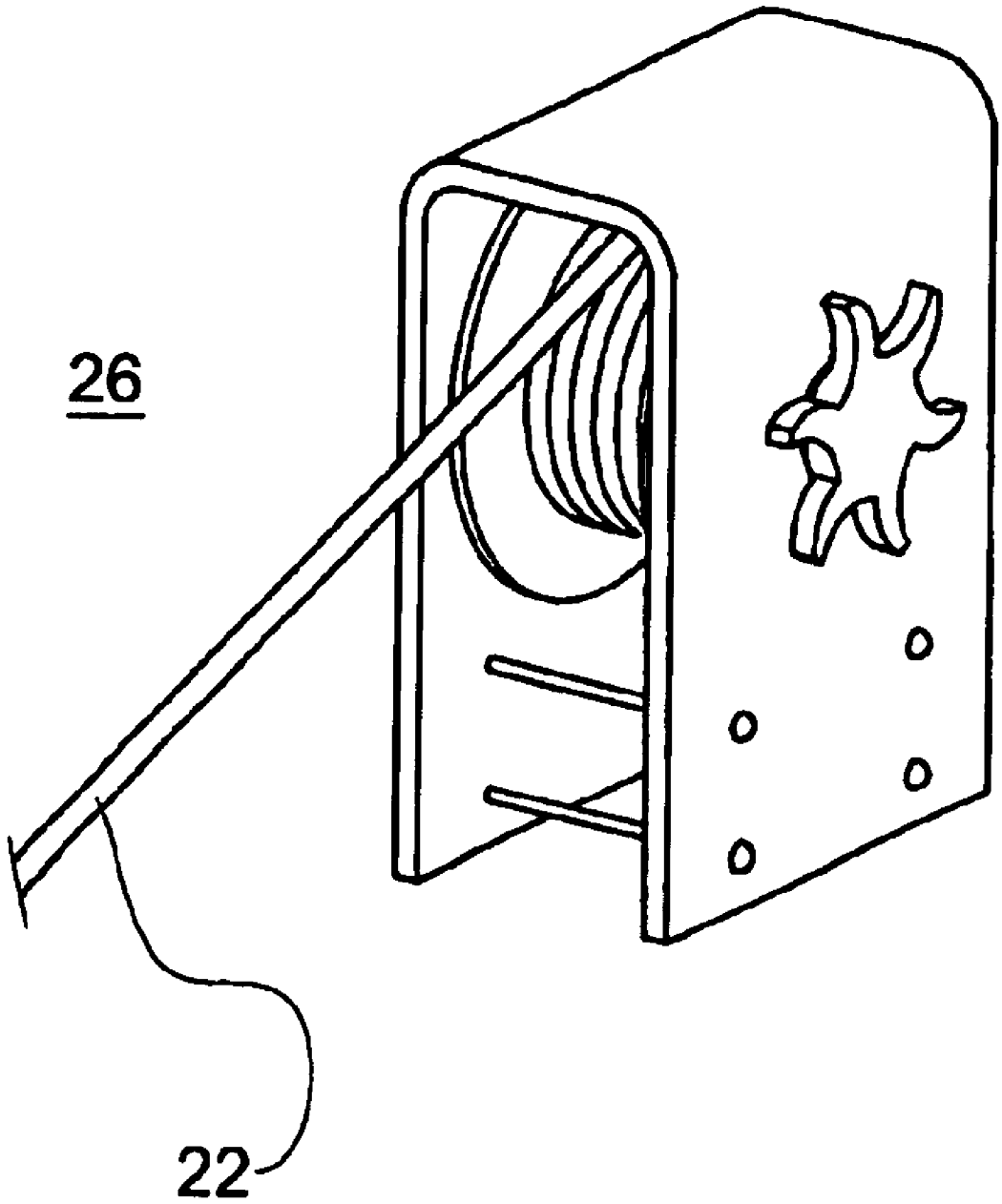
FIG. 4 is a perspective view of a cable winch.
Figure 5:
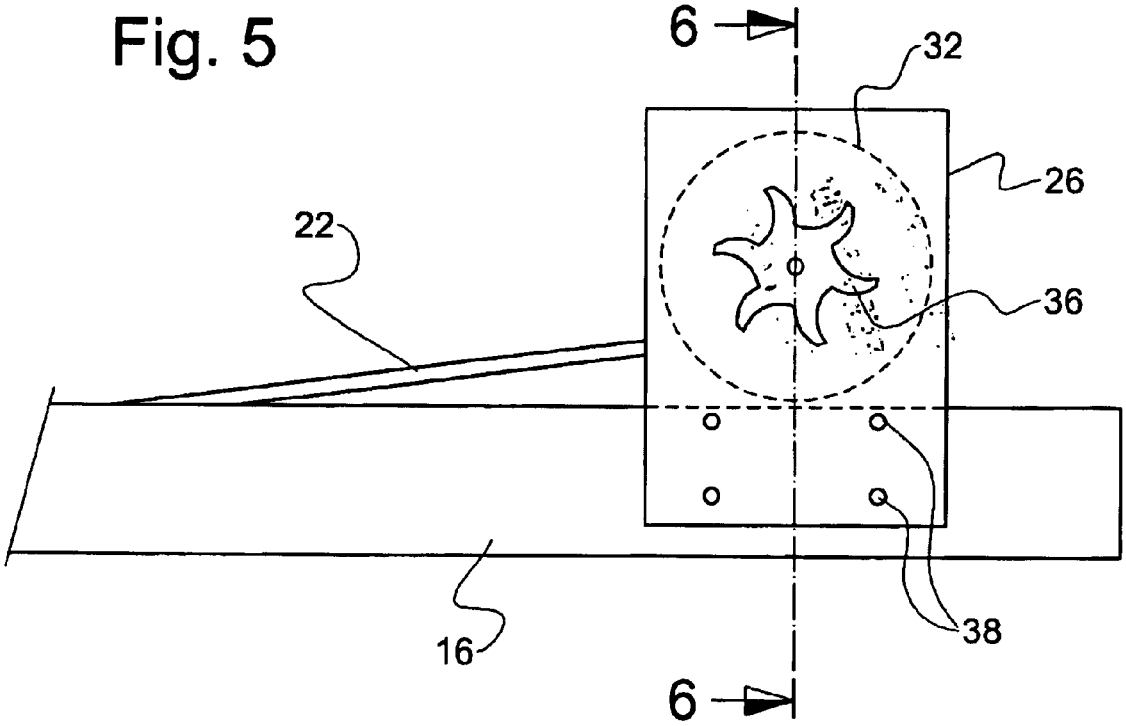
FIG. 5 is an elevational view of the cable winch.
Figure 6:
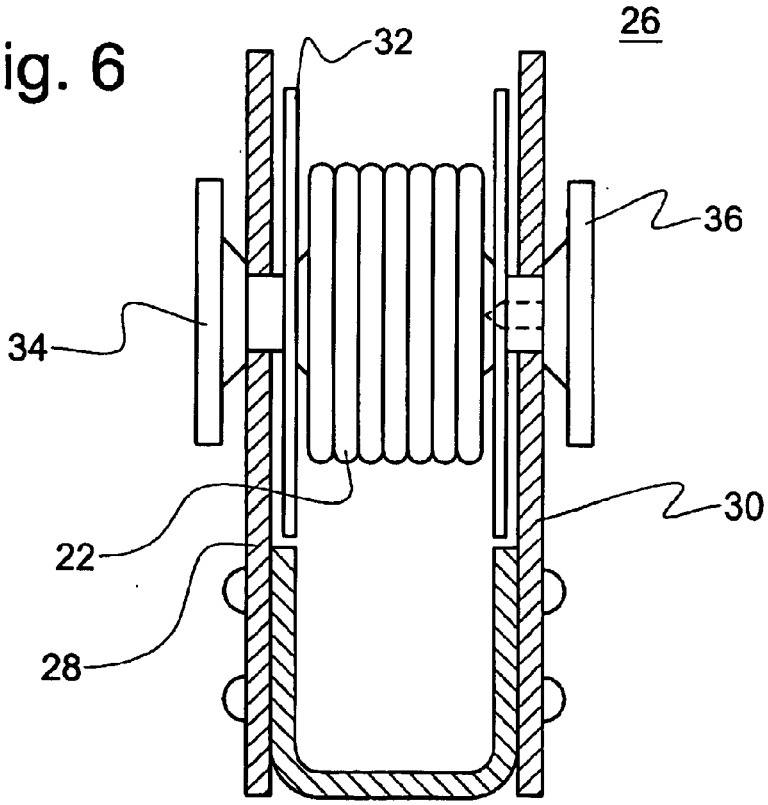
FIG. 6 is a cross-sectional view of the cable winch taken along the line 6—6 in FIG. 5.

FIGS. 4–6 show a cable winch 26 that is attached to the beam 16 for adjusting the handing distance of the string 22. The cable winch 26 has a first wall 28, a second wall 30, a winch pulley 32, a first wheel 34, and a second wheel 36. The winch pulley 32 is rotationally attached between the first wall 28 and the second wall 30. The first wheel 34 is fixed to the winch pulley 32 so that rotating the first wheel 34 rotates the winch pulley 32. A user of the device 10 can adjust the length of the string 22, and thus the hanging height of the basketball 24 by rotating the first wheel 34. The second wheel 36 is attached to the winch pulley 32 so that rotating the second wheel 36 in one direction, for example, clockwise, locks the winch pulley 32 and rotating the second wheel in the other direction, counterclockwise, unlocks the winch pulley 32. The winch pulley 32 is unlocked to allow rotation of the first wheel 34 and the winch pulley 32 so that the user can adjust the hanging length of the string 22. Then the winch pulley 32 is locked to keep the adjusted length of the string 22. The first wall 28 and the second wall 30 are attached to the beam 16 of the arm member 14 by bolts 38.

Figure 7:
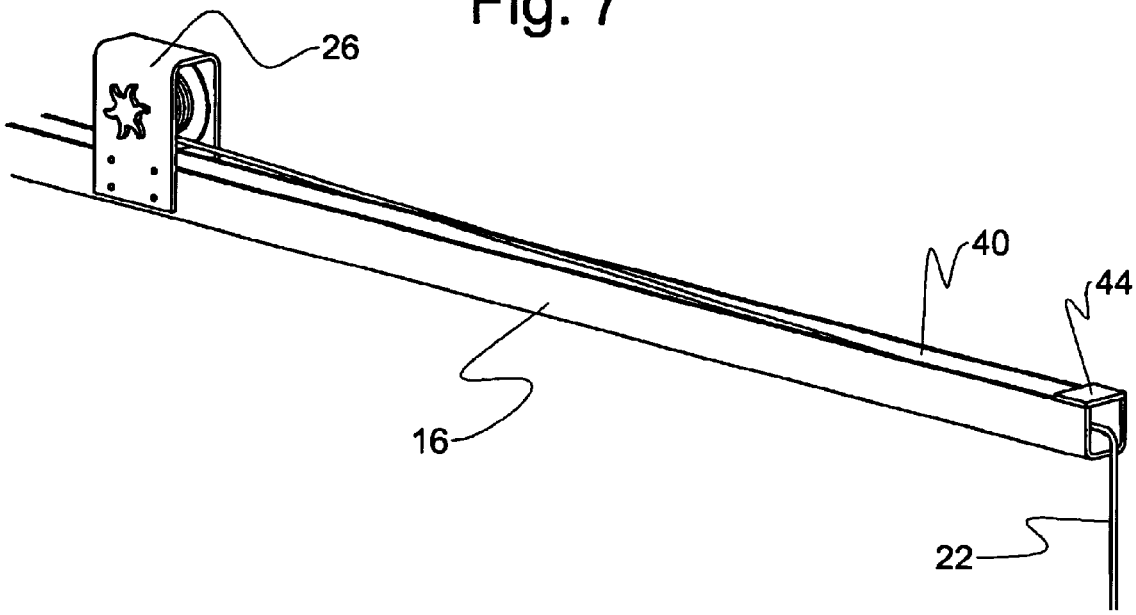
FIG. 7 is a perspective view of an arm and a string received in a channel of the arm and suspended from the end of the arm.
Figure 8:
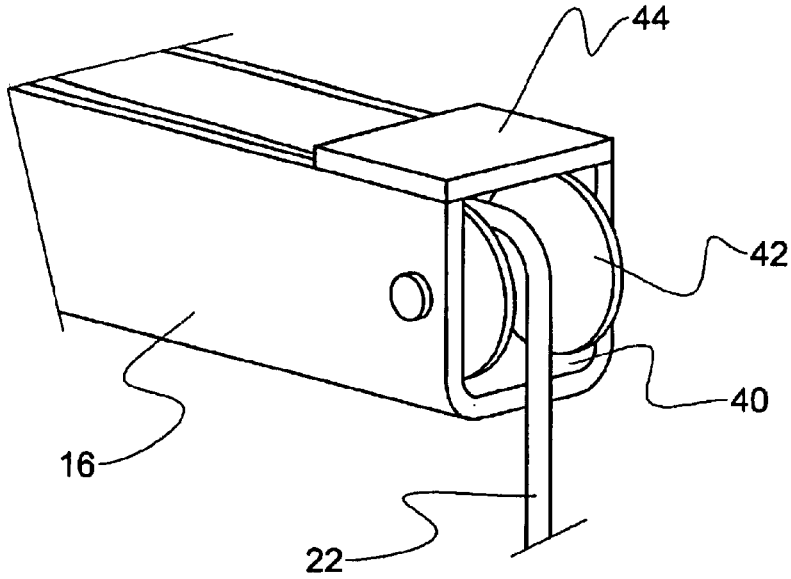
FIG. 8 is a perspective view showing that the string is supported by a pulley at the end of the arm.

FIGS. 7 and 8 show how the string 22 is guided to the second end 20 of the beam 16 and hung at the second end 20. The beam 16 has a channel 40. The string 22 runs in the channel 40 from the cable winch 26 to the second end 20. The string 22 can be hung directly at the second end 20 as shown in FIG. 7. Alternatively, an edge pulley 42 is provided at the second end 20 of the beam 16, and the string 22 goes over the edge pulley 42 before it hangs off the beam 16. The edge pulley 42 avoids friction between the string 22 and the beam 16 while changing the lengths of the string 22. The beam 16 also has a stopper 44 at the second end 20. The stopper 44 is a small plate that covers the channel 40 at the second end 20. The stopper 44 prevents the string 22 from getting out of the channel 40.

Referring back to FIG. 2, the support member 12 includes a base plate 46 on which the first ends 18 of the beams 16 are attached.

Figure 9:
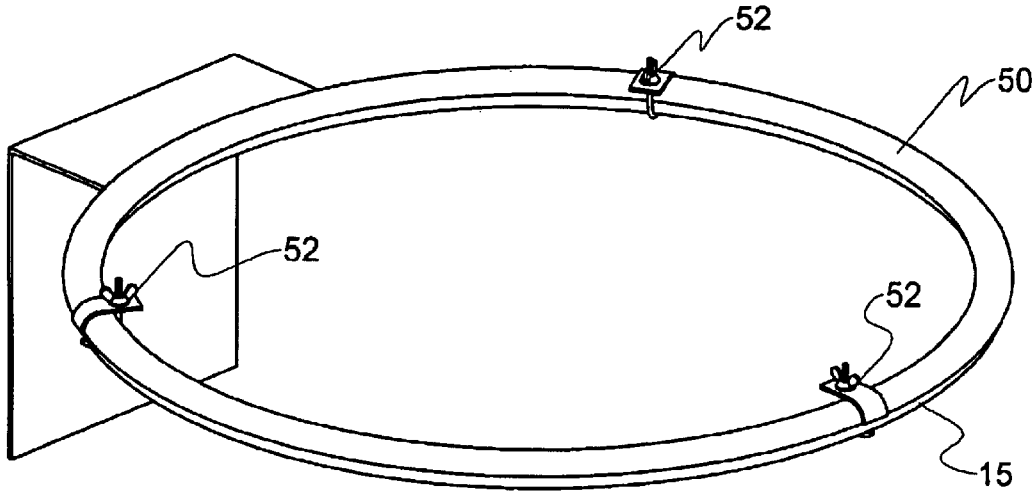
FIG. 9 is a perspective view showing a ring that is mounted on a rim of a basketball hoop.
Figure 10:
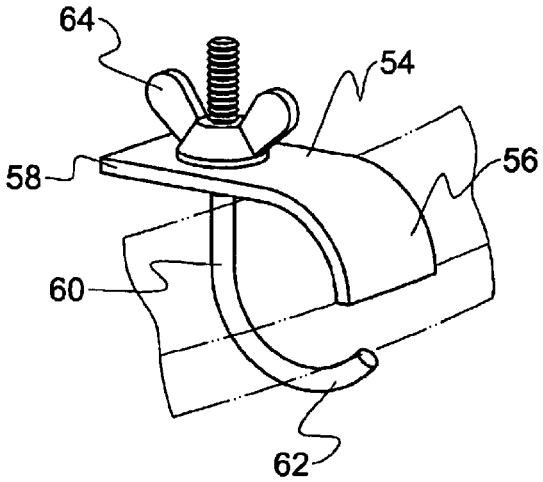
FIG. 10 is a perspective view showing a fastener to fix the ring to the rim.
Figure 11:
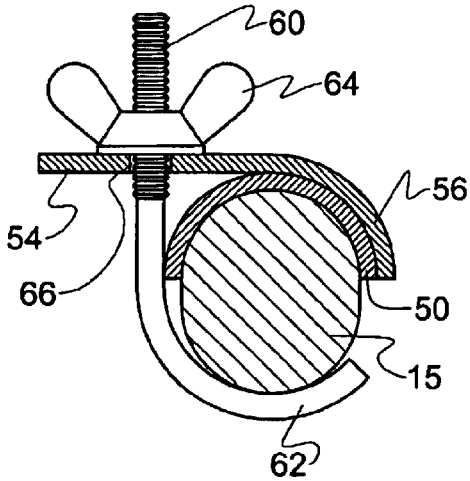
FIG. 11 is a cross-sectional view showing the fastener fixing the ring to the rim.

FIGS. 9–11 show how the device 10 is attached to the rim 15 of a basketball hoop. The support member 12 further includes a ring 50. The ring 50 has a semi-circular cross-section so that the ring 50 fits on the rim 15. As shown in FIGS. 1–3, the beams 14 are attached on the ring 50, for example by screws (not shown).

The support member 12 further includes a plurality of fastening members 52 that fasten the ring 50 to the rim 15. Each of the fastening members 52 includes a plate 54 having a curved portion 56 and a flat portion 58, a bolt 60 having a hook 62 on one end, and a butterfly nut 64. The curved portion 62 sits on the ring 50 and the flat portion has a hole 66. The bolt 60 passes through the hole 66 in the plate 54. In this way, fastening the butterfly nut 64 makes the hook 62 and the curved portion 56 surround the ring 50 and the rim 15 of the basketball hoop and secures the ring 50 to the rim 15.

Referring back to FIGS. 1 and 2, a support bar 68 may be attached to the support member 12. The length of the support bar 68 is approximately same as the diameter of the rim 15 of the basketball hoop. The support bar 68 aids in supporting the device 10 rigid and preventing the basketball 24 from going into the rim 15 of the basketball hoop.

By the above construction, the present invention provides a simple, light and convenient basketball rebounding practice device. The device is easy to mount on a rim of a basketball hoop, and the number of the basketballs, and the positions of basketballs can be easily controlled according to the requirements of various practice situations. The device of the present invention may be mounted on the basketball hoops at both ends of a basketball court. The user can shoot the basketball at one end of the court, rebound it, run to the other end and repeat.

While a preferred embodiment of the invention has been described and illustrated, it should be understood that many changes, substitutions and modifications to the described embodiment are possible. Therefore, many alternates are available, without departing from the scope and spirit of the present invention that is defined by the claims that follow.

What is claimed is:

1. A basketball rebounding practice device comprising:

a) A support member that can removably attached onto a rim of a basketball hoop; and b) one or more arm members attached to the support member;

wherein each of the arm members comprises a beam having a first end attached to the support member and a second end extending beyond the circumference of the rim by a predetermined length, and a string attached to the beam and hanging off the second end of the beam, wherein the string is capable of being attached at its hanging end to a basketball, wherein each of the arm members further comprises a cable winch attached to the beam for adjusting the handing distance of the string, wherein the cable winch comprises a first wall, a second wall, a winch pulley, a first wheel, and a second wheel, wherein the winch pulley is rotationally attached between the first wall and the second wall, wherein the first wheel is fixed to the winch pulley so that rotating the first wheel rotates the winch pulley, wherein the second wheel is attached to the winch pulley so that rotating the second wheel in one direction locks the winch pulley and rotating the second wheel in the other direction unlocks the winch pulley, and wherein the first wall and the second wall are attached to the beam of the arm member.

2. The basketball rebounding practice device of claim 1 wherein the beam comprises a channel in which the string runs.

3. The basketball rebounding practice device of claim 2 wherein the beam further comprises an edge pulley at the second end, wherein the string goes over the edge pulley before it hangs off the beam.

4. The basketball rebounding practice device of claim 2 wherein the beam further comprises a stopper at the second end for preventing the string from getting out of the channel.

5. The basketball rebounding practice device of claim 1 further comprising a support bar attached to the support member, wherein the length of the support bar is approximately same as the diameter of the rim of the basketball hoop.

6. The basketball rebounding practice device of claim 1 wherein the number of the arm members are 3 (three).

7. The basketball rebounding practice device of claim 1 wherein the number of the arm members are 5 (five).

8. The basketball rebounding practice device of claim 1 wherein the predetermined length is about 12 (twelve) inches.

9. The basketball rebounding practice device of claim 1 wherein the predetermined length is about 15 (fifteen) inches.

10. A basketball rebounding practice device comprising:

a) A support member that can removably attached onto a rim of a basketball hoop; and b) one or more arm members attached to the support member;

wherein each of the arm members comprises a beam having a first end attached to the support member and a second end extending beyond the circumference of the rim by a predetermined length, and a string attached to the beam and hanging off the second end of the beam, wherein the string is capable of being attached at its hanging end to a basketball, wherein the support member comprises a base plate on which the first ends of the beams are attached, and a ring having a semi-circular cross-section, and wherein the beams are attached on the ring.

11. The basketball rebounding practice device of claim 10 wherein the support member further comprises a plurality of fastening members that fasten the ring to the rim of the basket ball hoop.

12. The basketball rebounding practice device of claim 11 wherein each of the fastening members comprises a plate having a curved portion and a flat portion, a bolt having a hook on one end, and a butterfly nut, wherein the curved portion sits on the ring and the flat portion has a hole, wherein the bolt passes through the hole in the plate, whereby fastening the butterfly nut makes the hook and the curved portion surround the ring and the rim of the basketball hoop and secures the ring to the rim.

13. The basketball rebounding practice device of claim 10 wherein the beam comprises a channel in which the string runs.

14. The basketball rebounding practice device of claim 13 wherein the beam further comprises an edge pulley at the second end, wherein the string goes over the edge pulley before it hangs off the beam.

15. The basketball rebounding practice device of claim 13 wherein the beam further comprises a stopper at the second end for preventing the string from getting out of the channel.

16. The basketball rebounding practice device of claim 10 further comprising a support bar attached to the support member, wherein the length of the support bar is approximately same as the diameter of the rim of the basketball hoop.

17. The basketball rebounding practice device of claim 10 wherein the number of the arm members are 3 (three).

18. The basketball rebounding practice device of claim 10 wherein the number of the arm members are 5 (five).

19. The basketball rebounding practice device of claim 10 wherein the predetermined length is about 12 (twelve) inches.

20. The basketball rebounding practice device of claim 10 wherein the predetermined length is about 15 (fifteen) inches.

* * * * *